US005307919A

United States Patent [19]

Wente et al.

[11] Patent Number: 5,307,919

[45] Date of Patent: May 3, 1994

[54] BALUSTRADE PANEL HEIGHT FIXING DEVICE

[75] Inventors: Gerald Wente, Pohle; Willy Adrian, Obernkirchen, both of Fed. Rep. of Germany

[73] Assignee: Otis Elevator Company, Farmington, Conn.

[21] Appl. No.: 53,068

[22] Filed: Apr. 26, 1993

[51] Int. Cl.[5] ..... B66B 23/22

[52] U.S. Cl. ..... 198/335; 52/126.1

[58] Field of Search ..... 198/335, 337, 338; 52/126.1, 126.3

[56] References Cited

U.S. PATENT DOCUMENTS

| | | | |
|---|---|---|---|
| 3,991,877 | 11/1976 | Kraft et al. | 198/335 |
| 4,690,264 | 9/1987 | Adrian et al. | 198/335 |
| 4,819,781 | 4/1989 | Saito et al. | 198/335 |
| 4,842,122 | 6/1989 | Van Nort | 198/335 |
| 4,870,793 | 10/1989 | Tomlinson | 52/126.1 X |
| 5,029,690 | 7/1991 | Nguyen et al. | 198/335 |
| 5,156,521 | 10/1992 | Johnson | 198/335 |
| 5,215,177 | 6/1993 | Johnson et al. | 198/335 |

FOREIGN PATENT DOCUMENTS

| | | | |
|---|---|---|---|
| 0144396 | 6/1990 | Japan | 198/335 |

*Primary Examiner*—Cheryl L. Gastineau

[57] ABSTRACT

A balustrade assembly is provided having a balustrade panel, a panel holder, a clamp for clamping the balustrade panel in the panel holder, and an apparatus for adjusting the vertical position of the balustrade panel, independent of the clamp.

7 Claims, 2 Drawing Sheets

BALUSTRADE PANEL HEIGHT FIXING DEVICE

DESCRIPTION

1. Technical Field

This invention relates to people moving devices in general, and to balustrades in particular.

2. Background Art

Escalators, moving walkways, and other people moving devices efficiently move a large volume of pedestrian traffic from one point to another. Passengers step on moving steps (or belts, or pallets) and are transported along at a constant rate of speed. For safety reasons, passenger handrails are provided, traveling in the same direction and speed as the steps. A balustrade assembly supports and guides one of the handrails on each side of the steps.

Each balustrade assembly includes balustrade panels (typically glass) which extend up from a base to support the handrail. Externally, the base consists of a number of enclosure panels including an outer decking, an outer cladding, an inner profile, and a skirt panel. The outer decking and outer cladding enclose the mechanics on the side of the balustrade panel opposite the moving steps. The inner profile and skirt panel enclose the mechanics adjacent the moving steps.

Within the base, the balustrade panel is supported by a panel holder fixed to a bracket welded to the frame of the escalator. A clamping means clamps the balustrade panels within the panel holder(s). Typically, the clamping means also clamps a trim piece against the panel. On one side of the panel, the trim piece accepts and supports the edge of the outer decking, and on the other side, the trim piece accepts and supports the edge of the inner profile. The outer decking and inner profile panels are also supported by brackets or clips fixed to the frame or to the panel holder.

In addition to supporting the handrail, the balustrade assemblies also give the escalator its aesthetic appearance. The shape and composition of the balustrade assembly is carefully chosen to provide an aesthetic appeal. Paramount to this appeal is the appearance of quality. Passengers want to ride a quality escalator. Thus, it is highly desirable to ensure that all balustrade and base panels align properly. It is known in the art to have individual panel holders or extruded panel holder sections which may be adjusted to achieve the alignment desired. Specifically, most designs either use the means for clamping the balustrade panel as the means for adjusting the height of the panel, or the position of the panel holder itself is adjusted to achieve the desired panel height.

There are two problems with these approaches. First, adjusting a panel holder to align the balustrade panels may move the base panels out of alignment and therefore require a realignment of the base panels. Linking the alignment of the balustrade and base panels together makes the installation and maintenance of the balustrade a tedious chore. Second, if the clamping means is used to adjust the height of the balustrade panel, every time a balustrade panel is removed the height of the replacement panel must be adjusted. This method not only increases the installation time but also provides another opportunity for misalignment. In short, what is needed is a balustrade assembly able to overcome these problems.

DISCLOSURE OF THE INVENTION

It is an object of the present invention, therefore, to provide a balustrade assembly having a means to adjust the vertical position of the balustrade panel, independent of the means for clamping the balustrade panel in the panel holder.

According to the present invention, a balustrade assembly is provided having a balustrade panel, a panel holder, a clamp for clamping the balustrade panel in the panel holder, and means for adjusting the vertical position of the balustrade panel, independent of the clamp.

According further to the present invention, the adjustment means comprises an arm that extends into the panel holder, under the balustrade panel, thereby providing a support for the panel to rest on.

According still further to the present invention, a method for adjusting the height of a balustrade panel in a balustrade assembly is provided.

An advantage of the present invention lies in the facilitated alignment of the balustrade panels. The present invention allows the balustrade panels to be aligned independently and thereby decouples the alignment of the balustrade panels and the base panels.

A further advantage of the present invention is that once the means for adjusting the height of the balustrade panels is set, the panels can be removed and replaced without adjustment.

The foregoing and other objects, features and advantages of the present invention will become more apparent in light of the following detailed description and accompanying drawings.

BEST MODE FOR CARRYING OUT THE INVENTION

Figure 1:
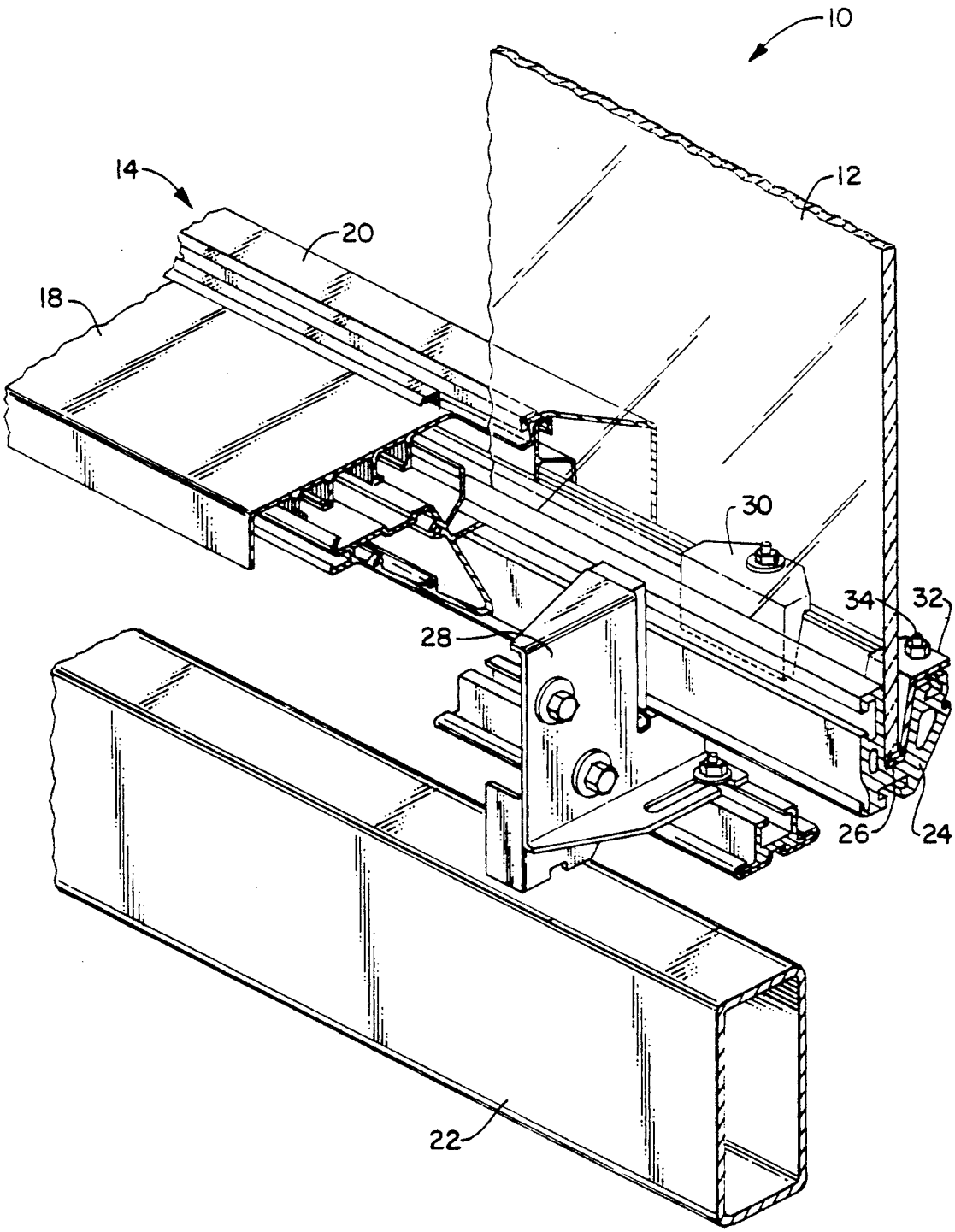
FIG. 1 is a perspective view of the balustrade assembly.
Figure 3:
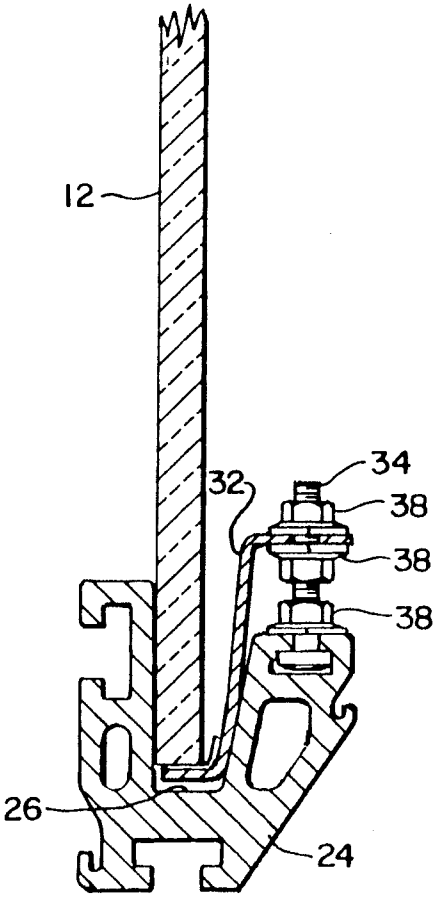
FIG. 3 is a diagrammatic front view of the balustrade assembly showing a second embodiment of the adjusting means.
Figure 2:
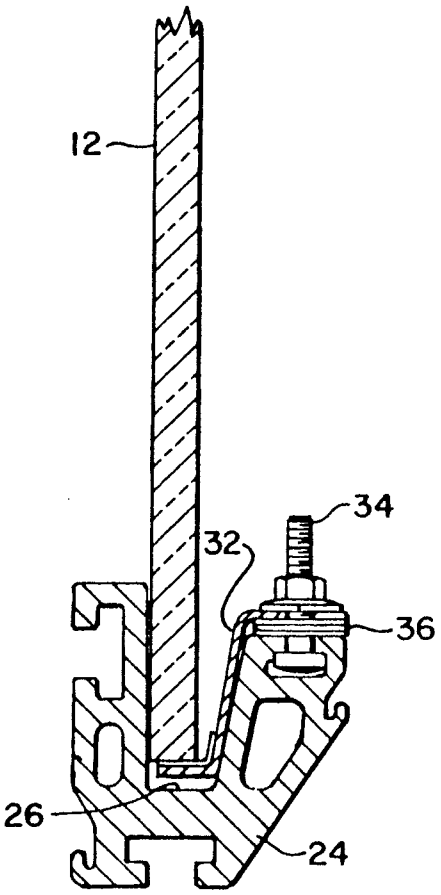
FIG. 2 is a diagrammatic front view of the balustrade assembly showing a first embodiment of the adjusting means.

Referring to FIG. 1, a balustrade assembly 10 for an escalator (not shown) is shown having a balustrade panel 12 extending up from a base 14. The base 14 comprises enclosure panels in the form of an outer decking 18 and an inner profile 20. The balustrade panel 12 is attached to the frame 22 of the escalator by a panel holder 24 located within the base 14, having a channel 26 for receiving the balustrade panel 12. The panel holder 24 is fixed to the frame 22 by an adjustable panel holder bracket 28. A wedge shaped clamp 30 fixes the balustrade panel 12 within the channel 26. A height adjusting arm 32, extending into the channel 26, vertically supports the balustrade panel 12 independent of the clamp 30. The arm 32 is attached to the panel holder 24 by a threaded fastener 34 which forms a mating male and female couple with the panel holder 24. Shims 36 or spacers (not shown) may be inserted between the panel holder 24 and the arm 32 (see FIG. 2). Alternatively, the threaded fastener 34 may include a nut 38 on each side of the arm 32 (see FIG. 3).

The method of adjusting the height of the balustrade panels 12 in a balustrade assembly begins when, prior to installation of the balustrade panel 12, two height adjusting arms 32 are loosely attached to the extruded panel holder section 24, one at each end of where the balustrade panel 12 will be positioned. If the panel holders 24 are independent units, a panel holder 24 with an attached height adjusting arm 32 is positioned at each end of the balustrade panel 12. The first balustrade panel 12 is then inserted into the channel 26 of the panel holder(s) 24. Using a reference point, the proper height of the balustrade panel 12 is determined and the arms 32 are adjusted to support the balustrade panel 12 at that height. In the first embodiment, the position of the arms 32 relative to the panel holder(s) 24 are adjusted by shims 36 or spacers (not shown). In the second embodiment, the position of the arms 32 relative to the panel holder(s) 24 are adjusted by moving the nuts 38 along the shaft of a threaded fastener 34. Once the height of the balustrade panel 12 is secured, extra height adjusting arms 32 may be installed as desired. Subsequently, the balustrade panel 12 is clamped within the channel(s) 26.

Adjusting the vertical height of balustrade panels 12 independent of the clamping means 30 provides several advantages. First, it facilitates the original assembly because it decouples the alignment of the balustrade panels 12 and the alignment of the base panels 18,20. The independent adjusting arms 32 also provide easy and accurate height adjustment. Second, if the assembled balustrade 10 must be partially disassembled for shipping, the height adjusting arms 32 which are left in during shipping, eliminate the need for alignment on the job site. Third, if a balustrade panel 12 either breaks or is defaced and must be replaced, the old panel can be removed and the new panel installed without alignment. In short, a balustrade assembly 10 having a means for adjusting the vertical height of the balustrade panels 12 has several distinct advantages.

Although the invention has been shown and described with respect to a best mode embodiment thereof, it should be understood by those skilled in the art that various other changes, omissions and additions in the form and detail thereof may be made therein without departing from the spirit and scope of the invention.

We claim:

1. A balustrade assembly, comprising:

a balustrade panel;

a panel holder, having a length and a channel, for attaching said balustrade panel to a structure;

a clamp, for clamping said balustrade panel within said channel; and means for adjusting the vertical position of said balustrade panel within said channel, independent of said clamp.

2. A balustrade for an escalator according to claim 1, wherein said adjusting means further comprises:

an arm; and means for attaching said arm to said panel holder, wherein said arm extends into said channel, under said balustrade panel, thereby supporting said panel at a specific position independent of said clamp.

3. A balustrade for an escalator according to claim 2, wherein said attaching means further comprises a threaded fastener.

4. A balustrade for an escalator according to claim 2, wherein said adjusting means further comprises a shim for spacing said arm relative to said panel holder.

5. A balustrade for an escalator according to claim 2, wherein said attachment means and said panel holder form a mating male and female pair which enable said arm to be attached at any position along said length of said panel holder.

6. A balustrade for an escalator according to claim 5, wherein said adjusting means further comprises means for adjusting the position of said arm relative to said panel holder.

7. A method for adjusting the height of a balustrade panel in a balustrade assembly, comprising the steps of:

providing a panel holder, having a length and a channel, for attaching the balustrade panel to a structure;

providing a clamp, for clamping the balustrade panel within said channel;

providing means for adjusting the vertical position of the balustrade panel within said channel, independent of said clamp.

adjusting the balustrade panel to a predetermined position with said adjusting means, independent of said clamp.

* * * * *